US005305695A

United States Patent [19]

Lichter

[11] Patent Number: 5,305,695

[45] Date of Patent: Apr. 26, 1994

[54] BURGLAR-RESISTANT LOCK-OPERATING CONSTRUCTION FOR SAFES

[76] Inventor: Robert J. Lichter, 15571 Placid Cir., Huntington Beach, Calif. 92647

[21] Appl. No.: 839,834

[22] Filed: Feb. 21, 1992

[51] Int. Cl.[5] ..... E05B 15/16

[52] U.S. Cl. ..... 109/59 R; 70/332; 70/417; 70/333 A

[58] Field of Search ..... 109/59 R, 69, 73; 70/332, 1.5, 333 A, 333 R, 416, 417, 329

[56] References Cited

U.S. PATENT DOCUMENTS

| | | | |
|---|---|---|---|
| 61,810 | 2/1867 | Corbett | 70/417 X |
| 105,800 | 7/1870 | Hall | 70/417 X |
| 1,579,126 | 3/1926 | Maxwell | 70/417 |
| 2,020,879 | 11/1935 | Eldred | 70/333 A X |
| 2,026,932 | 1/1936 | Cisor | 70/332 |
| 2,803,966 | 8/1957 | Morris | 70/332 |
| 2,836,052 | 5/1958 | Miller | 70/332 |
| 3,023,602 | 3/1962 | Foote et al. | 70/332 |
| 3,402,581 | 9/1968 | Schweizer et al. | 70/416 X |
| 4,158,337 | 6/1979 | Bahry et al. | 109/59 R |
| 4,197,726 | 4/1980 | Uyeda | 70/332 |
| 4,404,823 | 9/1983 | Miller et al. | 70/332 X |
| 4,532,785 | 8/1985 | Uyeda | 70/1.5 X |
| 4,628,715 | 12/1986 | Uyeda et al. | 70/417 X |
| 4,712,490 | 12/1987 | Lichter | 109/73 X |
| 4,765,165 | 8/1988 | O'Gara | 70/417 |
| 5,176,016 | 1/1993 | Hill | 70/417 |

*Primary Examiner*—Peter M. Cuomo
*Assistant Examiner*—Suzanne L. Dino
*Attorney, Agent, or Firm*—Richard L. Gausewitz

[57] ABSTRACT

A safe has, in addition to its strong body and door and its combination lock knob and dial, a security mask that is strongly and fixedly secured to the upper side of the door over major portions of the dial, for the purpose of preventing a burglar from hammering on the dial and then driving the spindle and actuating the relockers of the safe. In accordance with another aspect of the invention, an anti auto-dialer is fixedly connected to the security mask over the knob of the combination lock mechanism, to prevent operative engagement between the knob and an auto-dialer mechanism while at the same time permitting manual operation of the knob to work the combination.

9 Claims, 3 Drawing Sheets

BURGLAR-RESISTANT LOCK-OPERATING CONSTRUCTION FOR SAFES

BACKGROUND OF THE INVENTION

When a typical (nonprofessional) burglar attacks a safe in a home, motor home, etc., he or she finds a hammer and uses that hammer to knock the knob and dial off the dialing means. Then, the burglar uses the hammer, a screwdriver, or other tools to pound on the spindle, thus driving it downwardly. This forces the bottom plate of the housing of the lock mechanism away from the main body of such lock housing. This, in turn, operates the relockers. The relockers normally stop the burglar from entering the safe.

The result, however, is a large problem in the safe industry, an industry which relies heavily on relockers to prevent the indicated type of entry. The problem is that it is often very expensive for a locksmith hired by the owner of the safe to put the damaged safe back into operating condition after the burglar has done his or her damage. In some cases, the cost of putting the safe back into operating condition may approximate the initial cost of the safe itself. This is particularly true where the safe is embedded in concrete, as is often the case.

A distinct problem involved relative to apparatus mounted on the doors of safes is that the industry—and the underwriters—do not want any holes in the doors other than the single hole necessitated by the spindle of the lock mechanism. Thus, it is important that there be no additional unplugged holes.

Another type of entry into a safe, this one being employed by professional burglars, involves a computer-controlled automatic-dialing system. The burglar simply connects such system to the knob on the safe dial, following which the auto-dial system dials enormous numbers of combinations until the right one is reached. For such a system to work, it is typically necessary that there be a knob present on the dial, and that the knob be accessible to the auto-dialer.

SUMMARY OF THE INVENTION

In accordance with one aspect of the present invention, burglar-resistant means are provided on the top of the safe door to reduce the chances that the burglar can remove the dial and knob of the safe, as by pounding on them. If the dial remains intact, and if the associated spindle remains intact, it is usually possible for a locksmith to open the safe without resorting to highly expensive drilling and other procedures.

In accordance with another aspect of the present invention, means are provided to protect the knob of the lock-dialing mechanism, both against pounding by an amateur burglar and against automatic dialing by a professional burglar.

In accordance with another aspect of the invention, means are provided to reduce the risk that the spindle can be driven downwardly by a burglar, thus tripping the relockers, such means being inexpensive and practical.

In accordance with another aspect of the invention, the knob of the safe-dialing means is caused to be removable from the dial, in such manner that the owner of the safe can remove the knob at any time and can later replace it in any position whatever and the dialing means will still work.

In accordance with another aspect of the present invention, means are provided to secure a security mask on the exterior of a safe door without at the same time leaving unplugged holes in such door.

DETAILED DESCRIPTION OF THE PREFERRED EMBODIMENTS

The present invention may be incorporated in locking mechanisms for various types of safe doors, including hinged doors and sliding doors, and any liftout-door safes. In the illustrated embodiments, the door is for a safe of the sliding-door type. More specifically, the sliding-door safe is constructed in accordance with U.S. Pat. No. 4,712,490, for a Safe. Such patent is hereby incorporated by reference herein.

Figure 1:
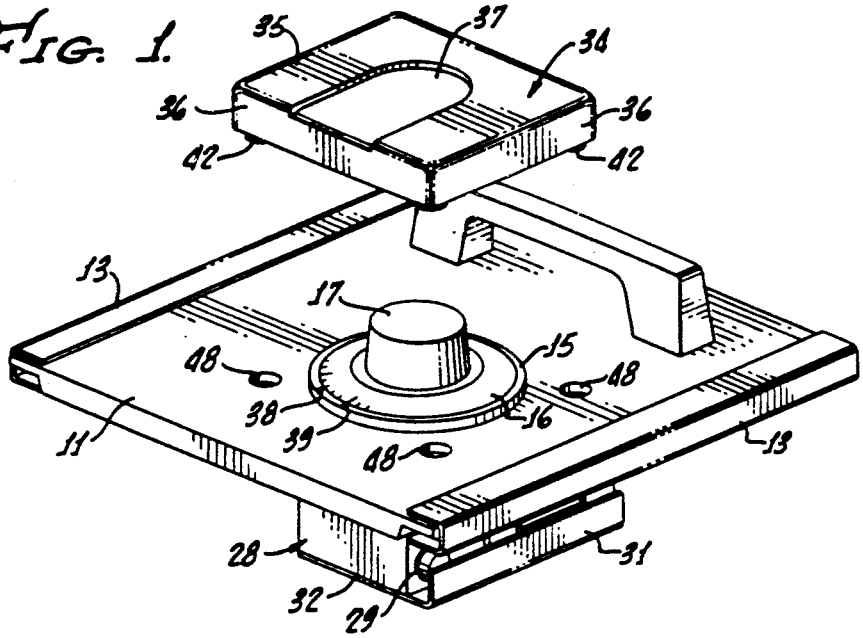
FIG. 1 is a partially-exploded isometric view of a safe door incorporating a lock-operating mechanism constructed in accordance with a first embodiment of the invention.
Figure 2:
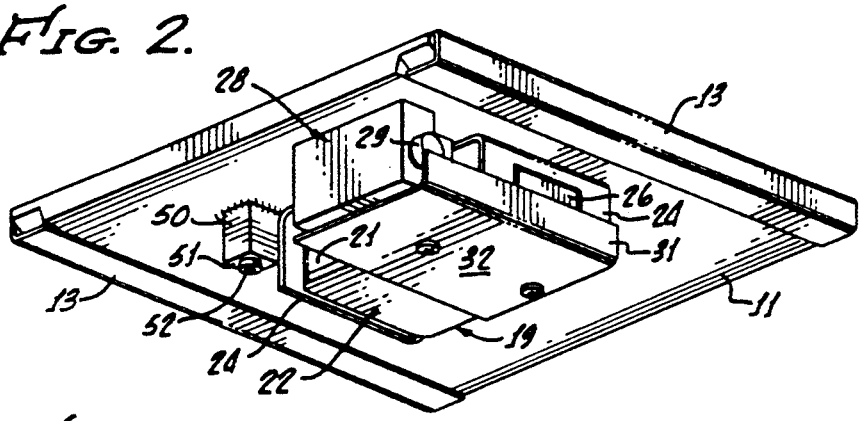
FIG. 2 is an isometric view showing the lower portion of the door of FIG. 1.
Figure 3:
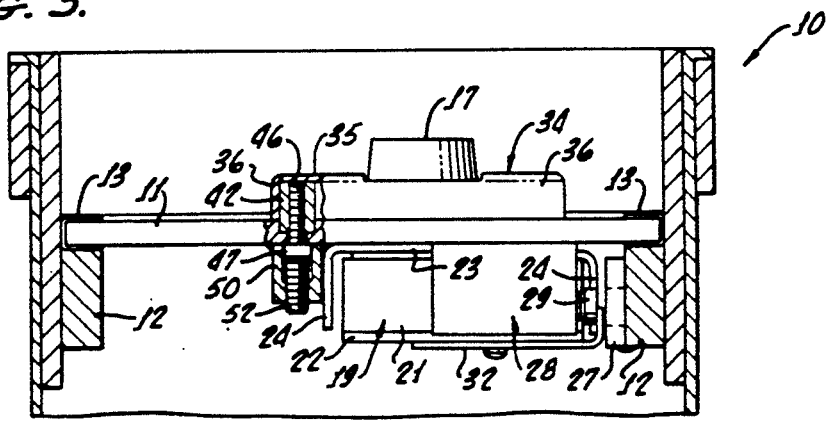
FIG. 3 is a vertical sectional view showing the door of FIGS. 1 and 2 in a safe of the sliding-door type.
Figure 4:
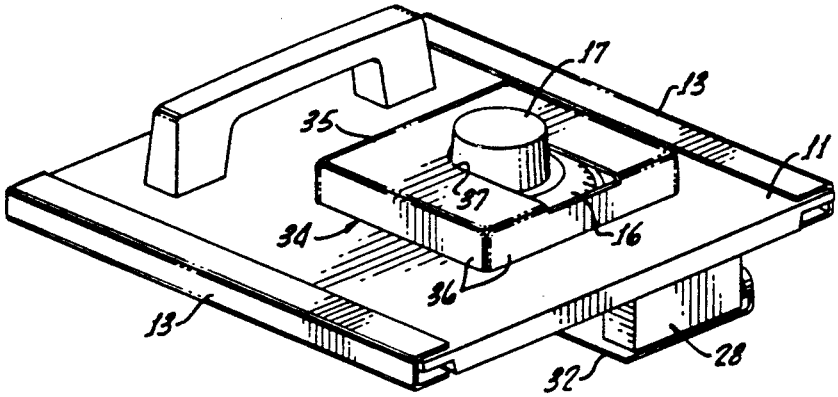
FIG. 4 is an isometric view of the door of FIGS. 1–3, as viewed from a different angle, and with the security mask in fully-mounted condition.

Referring first to FIGS. 1–3, the safe is indicated at 10 (FIG. 3), being normally closed by a strong sliding steel door 11 the side edges of which slide on bars 12 between unlocking and locking positions. The door edges that rest on bars 12 are covered by synthetic resin channels 13 for the purpose of reducing friction.

A fixed "ring" 15 is secured, by screws, to the top surface of door 11. Ring 15 is a plastic or metal disc that underlies the dial. Such ring 15 has at its periphery at least one, and normally two, marks on the upper side thereof to serve as a reference point for the dialing operation. A dial 16 is rotatably mounted within fixed ring 15 and has all the dial numbers and marks on the upper side thereof. Dial 16 is integral with a knob 17 adapted to be turned by the operator. Knob 17 is press-fit onto the spindle of the locking mechanism.

The knob 17 turns a spindle 18 (shown in FIG. 8 relative to another embodiment), which spindle extends downwardly through door 11. The lower portion of the spindle is within the conventional locking mechanism 19 of the safe. Such locking mechanism may be of various types that have been used for many years in the safe industry, and which typically incorporate relocking means. One such locking mechanism bears the following U.S. Pat. Nos.: 4,142,388, 4,628,715, 4,532,785, 4,197,726 and 4,222,251. Such patents are hereby incorporated by reference herein. The preferred lock mechanism employed by applicant is termed "Group III"; such lock is obtained from LaGard Inc. of Torrance, Calif.

Locking mechanism 19 has a housing 21 that incorporates a bottom plate 22 which is easily removed by being pounded downwardly. Housing 21 is secured by screws (which extend through the top housing wall) into "hard plates" 23 that are welded to the bottom surface of sliding door 11. In the illustrated embodiment, there are two hard plates 23, both being angle shaped, both welded to the bottom surface of door 11. The hard plates have opposed flange portions 24 that extend vertically parallel to opposite vertical walls of housing 21. Because the plates 23 are hardened, the risk is reduced that the burglar will drill through door 11 into locking mechanism 19.

The locking mechanism 19 has a bolt 26 (FIG. 2) that extends out from housing 21 and through a slot in one of the flanges 24. Bolt 26, when extended, is immediately adjacent a securely-anchored (as by welding) plate 27 (FIG. 3) that is located to prevent the door 11 from being slid to an unlocking position unless the bolt is retracted.

It is a main purpose of the present invention to vastly reduce the number of occasions when any relocking mechanism will be tripped. Nevertheless, it is preferred that relocking mechanisms be employed, for extra safety and redundancy. One such relocking mechanism is built into the locking mechanism 19. Another is shown at 28, being a steel block that is welded to the underside of door 11 and has a spring-pressed plunger 29 therein. As shown (for example) in FIG. 2, plunger 29 is normally held retracted by a flange 31 on a plate 32 that is secured by screws to the bottom plate 22 of lock housing 21.

In the event that, despite the mechanisms described below, the burglar succeeds in driving the spindle of the lock mechanism, this causes bottom plate 22 to be forced downwardly away from the lock housing 21. Since plate 32 and its flange 31 are secured to bottom plate 22, they are likewise driven downwardly, the flange 31 then no longer being adjacent plunger 29. The plunger 29 is then spring-pressed outwardly and enters a corresponding hole in plate 27. This prevents sliding of the door even in the event of malfunctioning of the relocking mechanism already provided in locking mechanism 19.

First Embodiment of Apparatus for Reducing Greatly the Chances that a Burglar will Destroy the Dial 16 and Knob 17, and Drive the Spindle An open-bottomed rectangular security mask 34, strongly formed of steel, is rigidly secured to the top of door 11 in a manner—described below—that does not make it possible for any unplugged holes to exist in the door. Mask 34 has a top wall 35 and four downwardly-extending sidewalls 36, the latter having relatively small vertical dimensions.

An opening 37 is formed in top wall 35 and is barely adapted to receive the knob 17. Furthermore, opening 37 extends to one sidewall 36 to expose a portion of dial 16 to view. This portion is adjacent reference marks 38,39 (FIG. 1) on the upper surface of ring 15.

Thus, the owner of the safe is not hindered from spinning the dial 16 and opening the safe. On the other hand, a burglar is impeded—both actually and psychologically—from effectively attacking the knob 17 and dial 16 with a hammer. If the burglar does pound on the knob 17 with a hammer, sufficiently to break the spindle of the locking mechanism as described below, the knob 17 and dial 16 still remain in the security mask 34, being trapped therein unless and until broken up by the burglar.

Preferably, the security mask is bent out of strong sheet steel and then welded at the corners. Preferably, the mask is not hardened, so that it will not shatter when pounded by a hammer being swung by the burglar.

Proceeding next to a description of the means for securing the security mask to the door 11, this includes interiorly-threaded elongate cylindrical tubes 42, there being one such tube welded securely in each interior corner of the mask 34. The tubes project vertically to top wall 35, and extend below the lower edges of sidewalls 36 as shown at the left in FIG. 3.

At positions corresponding to the desired locations of tubes (legs) 42, namely around the dial, door 11 is bored to form in the lower portion thereof four holes adapted to receive the threaded shanks of upwardly-extending machine screws 46 having socket heads 47. At door regions immediately above and concentric with the holes for machine screws 47, door 11 is counterbored to make cylindrical recesses 48 of such size as to receive snugly the lower ends of tubes 42, reference being made to FIG. 3.

Four small but strong metal housings 50 (FIG. 2), having open upper ends, are welded securely to the undersides of door 11 in axial alignment with screws 46. The lower ends of housings 50 are closed by bottom walls 51. Such bottom walls have interiorly-threaded bores therein to receive elongate set screws 52. The set screws are sufficiently long, as shown in FIG. 3, to bear tightly against the bottoms of heads 47 when screws 46 are fully tightened.

The screws 46, set screws 52, tubes 42 and housings 50 are hardened to resist drilling.

Security mask 34 is secured to door 11 by threading the machine screws 46 into threaded tubes 42 until the screws are tightened, the lower ends of tubes 42 then seating snugly in counterbores or recesses 48. Such threading of the machine screws is done by a wrench extended through bottom wall 51. At this time, the upper surfaces of heads 47 of the screws 46 seat against the underside of door 11. Set screws 52 are then inserted and are threaded axially upwardly until they bear very tightly against the heads 47.

When a strong-arm burglar pounds against the security mask 34, removal of that mask is strongly resisted by the screws 46 and associated tubes 42 and the walls of counterbores 48, it being emphasized that the walls of tubes 42 bear against the walls of counterbores 48 to strengthen the resistance to lateral movement in response to the hammering. Even if the burglar is successful in dislodging the security mask 34, the screws 46 nevertheless remain projecting upwardly through the door 11 at all four holes, thus effectively plugging the holes in the door.

The plugging action is greatly enhanced by the set screws 52 that bear firmly against the heads 47. However, even if the set screws 52 were not present, the heads 47 could not move downwardly sufficiently far to permit the upper ends of screws 46 to pass downwardly through the bores in the door 11. This is because the heads 47 are larger than are the bores for set screws 52, and the lengths of the screws 46 are so great that they can never move downwardly away from door 11.

ANTI AUTO-DIALER EMBODIMENT

Figure 5:
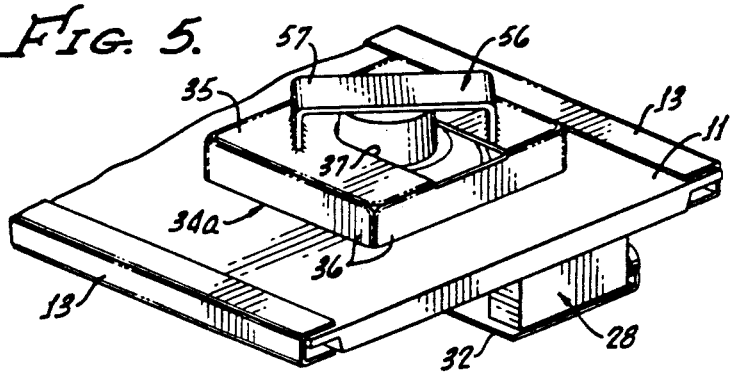
FIG. 5 is an isometric view of a second embodiment of the invention, in which additional means are provided to protect the knob of the safe against operation by computer-controlled automatic dialers.

Except as specifically stated, the construction of the embodiment of FIG. 5 is identical to that of FIGS. 1–4, inclusive.

In the security mask 34*a* of FIG. 5, If in anti-auto dialer bridge 56 is welded to the upper surface of mask wall 35. Bridge 56 has a horizontal body 57 and two legs 58, the bottom ends of the latter being securely welded to wall 35. In the preferred form, body 57 extends diagonally of the mask wall 35, namely from generally the upper-left region thereof to the lower-right region thereof as shown in FIG. 5. This facilitates operation of the knob 17 by a right-handed dialer located adjacent the lower-right portion of the showing of FIG. 5.

Body 57 is closely adjacent the upper surface of knob 17, but preferably not in contact therewith.

In the operation of the embodiment of FIG. 5, the bridge 56 resists mounting of a computer-operated automatic dialer on the knob 17, as by a professional burglar. If the burglar hammers on the mask 34*a* and bridge 56 in an attempt to remove the security mask 34*a*, this will in all probability damage the knob 17. Then, even if the burglar succeeds in removing the bridge 56, it will be difficult or impossible for the automatic dialer to work with the damaged knob 17.

INVENTION SHOWN BY FIGS. 6 AND 7

Figure 6:
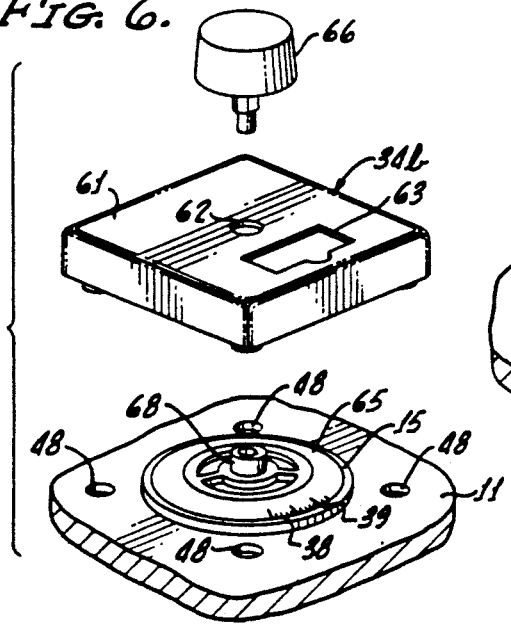
FIG. 6 is an exploded isometric view of a third embodiment of the invention, in which the security mask is constructed to provide additional protection against pounding, and in which the knob is removable by the owner of the safe.
Figure 7:
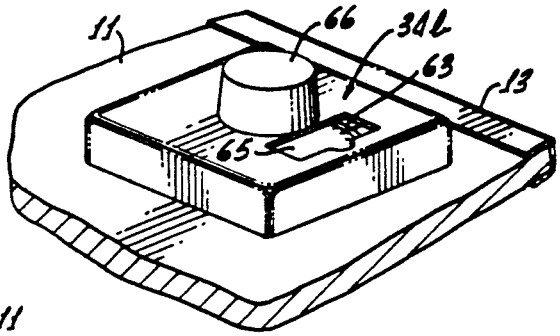
FIG. 7 is an isometric view showing the lock-operating and lock-protecting mechanism of FIG. 6 in fully assembled condition.

FIGS. 6 and 7 show a third embodiment which is functionally a vast improvement over the embodiment of FIGS. 1–4. In the embodiment of FIGS. 6 and 7, there is no knob present for the burglar to hammer on. Furthermore, the dial is shielded from hammer blows to a much greater extent than is the case relative to the embodiment of FIGS. 1–4. The FIG. 6–7 embodiment is the preferred one.

Except as specifically stated, the structure of the embodiment of FIGS. 6 and 7 is identical to that of FIGS. 1–4.

The security mask 34*b* has an upper wall 61 that is continuous except for a small central hole 62 and a small viewing slot 63. The viewing slot 63 is disposed over the fixed ring 15 shown in FIG. 6. Namely, the slot 63 is over the indicia 38,39 on the upper surface of fixed ring 15.

Figure 8:
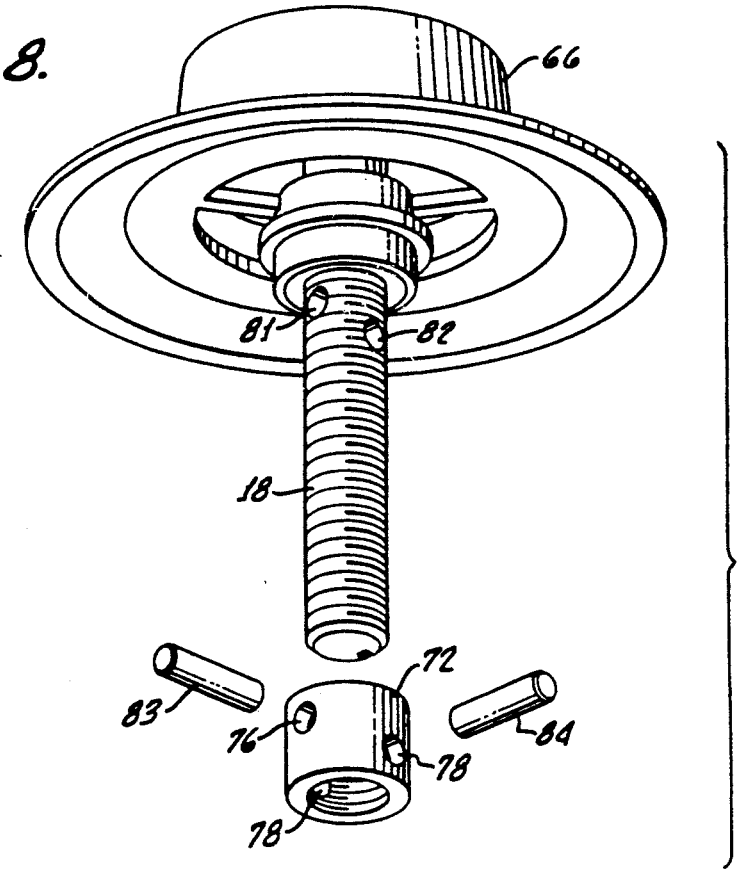
FIG. 8, is an exploded view of the spindle of the lock-operating mechanism, and associated collar and pins.
Figure 9:
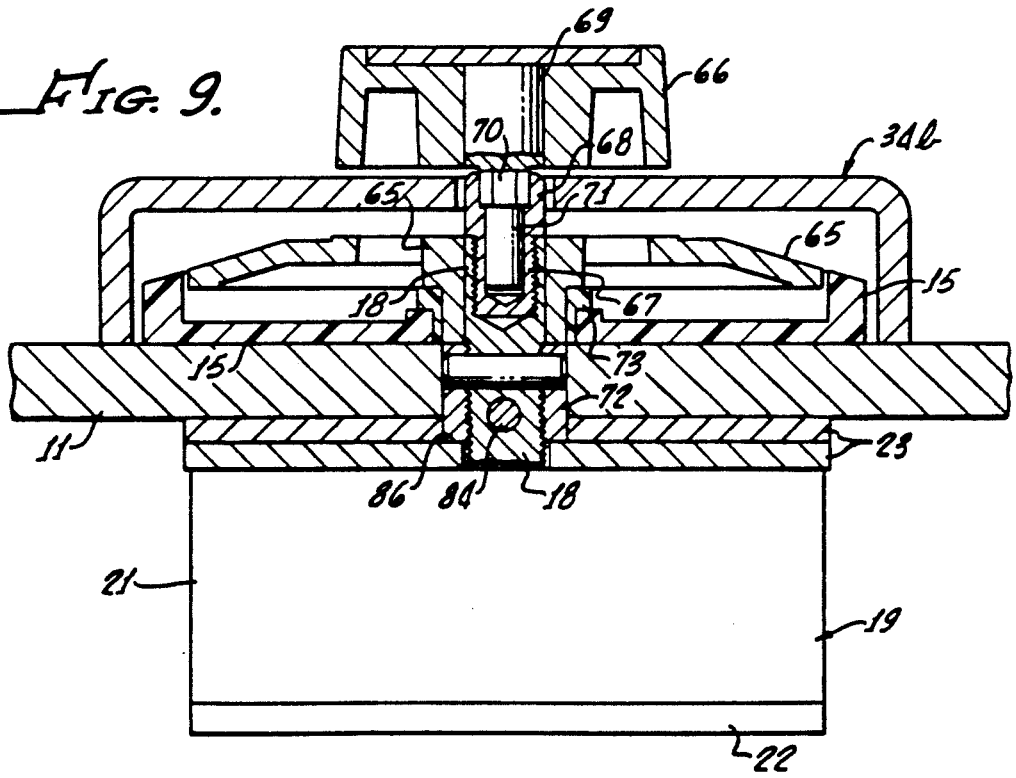
FIG. 9 is a vertical sectional view of the construction of FIG. 8 when such construction is in assembled condition, and when the security mask of FIGS. 6 and 7 is present.

Referring next to FIGS. 6, 8 and 9, the dial 65 is not integral with the knob 66, being instead connected to the knob only after the security mask 34*b* has been mounted in position over the dial 65 and its associated ring 15. After such mounting of the security mask, knob 66 is connected axially to the dial and to the spindle 18 therebeneath, in such manner that rotation of the knob rotates the dial 65 to operate the locking mechanism of the combination lock. The connection between knob and dial is such that turning of the knob effects a corresponding turning of dial 65.

In the greatly preferred manner of connecting knob 66 to dial 65 and to spindle 18, the nonrotatable connection therebetween is such that the knob lifts out and may be located or carried anywhere by or with the owner of the safe. Then, when a burglar attempts to enter the safe, he or she has no knob to pound on. The small hole 62 and the view slot 63 are what are seen by the burglar, who also sees only a portion of the dial beneath the viewing slot.

In the preferred apparatus for nonrotatably and removably connecting the knob 66 to the dial 65 and spindle 18, the upper end of the spindle 18 is axially drilled and tapped so as to receive the threaded shank of a machine screw 67 having a socket head 68 at the upper end thereof. The dial 65 is press-fit onto the spindle 18, just below socket head 68. Such socket head seats on the upper end of the spindle.

Knob 66 has axially mounted therein, by press-fitting, a short shaft 69 that is hexagonal at its region just under the knob, being sized to fit nonrotatably into socket head 68. The hexagonal shaft region is numbered 70. A cylindrical shaft extension 71 is provided coaxially on the lower end of short shaft 69 and extends snugly downwardly into a corresponding bore in machine screw 67. The extension 71 cooperates with the hex region 70 in providing a nonrotatable, snug connection between the knob 66 and the screw 67 and spindle 18.

The Anti-Triggering (Anti-Driving) Means

In accordance with one major aspect of the invention, means are provided on and adjacent the spindle 18 itself to vastly reduce the chances that it will be pounded down or drilled, thus greatly reducing the chances that the relocking mechanisms will be operated with consequent major expense to the safe owner. Many burglars will, as above stated, hammer on the spindle if they have succeeded in accessing the same. More sophisticated burglars will attempt to drill down through the spindle, some even drilling through the knob such as knob 17 of the first embodiment of the present invention. There will next be described the means for making it extremely difficult to drive the spindle 18 downwardly by pounding with a hammer and/or screwdriver, or to drill the spindle.

Referring to FIGS. 8 and 9, a hardened steel collar 72 is threaded onto spindle 18 sufficiently far to be at the upper end portion thereof, close to a central hub region of dial 65. The collar is also closely adjacent a synthetic resin bearing ring 73 that rotates in and seats on (as shown in FIG. 9) central region of the conventional ring (disc) 15.

Collar 72 is drilled to form diametrically-opposite holes 76 in an upper region thereof, and diametrically-opposite holes 78 in a lower region thereof. The axes of holes 76,78 are preferably at right angles to each other. Upper and lower holes 81,82 are also formed in spindle 18, in such locations as to be registered with holes 76,78, when collar 72 is in mounted condition as shown in FIG. 9.

An upper hardened steel pin 83 is extended through the registered holes 81 and 76, while a lower hardened steel pin 84 is extended through registered holes 82 and 78.

Referring to FIG. 9, door 11 and the upper hard plate 23 are correspondingly bored so that the bore walls are sliding fits relative to the exterior surface of collar 72, when such collar is disposed in the bores in door 11 and upper hard plate 23. Preferably, the length of the collar 72 is substantially equal to the combined thicknesses of door 11 and upper hard plate 23, so that the upper end of the collar is substantially flush with the upper surface of door 11. This makes it more difficult to hammer on the collar 72. The lower end of collar 72 rests rotatably on a bearing surface portion 86 of lower hard plate 23, such lower hard plate being bored with a hole that is sized to rotatably receive only the spindle 18 and not the collar 72.

Typically, the spindle 18 is formed of aluminum and—in the absence of the security masks described above—is readily broken by a burglar. Even with a security mask, large amounts of sustained effort may cause the spindle 18 to break. Breakage will typically occur at the upper hole 81 (for pin 83) in spindle 18, because that is where the spindle is relatively weak and is less supported by the bore wall than is the spindle region at the lower pin 84.

Then, the burglar hammers on the collar 72 but the force of such hammering is absorbed by the lower hard plate 23 on which collar 72 rests. When the burglar hammers on the remaining portion of spindle 18, as by use of a screwdriver or a rod, the force of the blows is absorbed by the threads that connect the spindle to the collar, and by the pins 83 and 84 that also connect the spindle to the collar.

When the burglar employs a drill to drill down the spindle 18, he or she encounters pins 83 and 84. Both pins remain in position, and both resist drilling. The hard pins 83,84, the hard plate 23, and the hard collar 72, make it extremely difficult for the burglar to drill down into the lock mechanism 19.

It follows that if the spindle has not been driven downwardly or drilled, and the relocking mechanisms have not been triggered, it is enormously easier for the locksmith to put the safe back into operating condition.

It is pointed out that at least the pin 84 prevents any rotation of collar 72 relative to the spindle 18, so that both the pin 84 and the threads that interconnect the spindle with the collar prevent the burglar from lifting collar 72 out of its bores.

The holes 81,82,76 and 78, the pins 83,84, the collar 72, etc., are also present in the embodiments of FIGS. 1–5, inclusive.

The foregoing detailed description is to be clearly understood as given by way of illustration and example only, the spirit and scope of this invention being limited solely by the appended claims.

What is claimed is:

1. A safe for valuables, which comprises:

(a) a strong body having a space therein adapted to contain valuables, said body having an opening therein extending from said space to the exterior of said body, and through which objects may be passed into and out of said space, (b) a strong steel door provided on said body over said opening to block said opening when said door is in closed condition, (c) lock means to lock said door in closed condition, said lock means including a combination lock mechanism on the inside of said door, a knob on the outside of said door, and a spindle extending rotatably through said door between said knob and said lock mechanism so that rotations of said knob are transmitted by said spindle to said lock mechanism, said knob being coaxial with said spindle, said knob having a dial associated coaxially therewith on the outside of said door for rotation therewith, (d) means to provide indicia in fixed relationship to said door and adjacent said dial for cooperation with said dial in determining the correct rotated positions of said knob, (e) a strong steel security mask provided over said dial on the outside of said door, said security mask having an opening therein sufficiently large to permit a person operating said knob to see said indicia and the portion of said dial near said indicia, said security mask and knob being so associated with each other that said knob may be manually operated at all times, (f) means to strongly, fixedly and nonremovably secure said security mask to the outside of said door to thereby tend strongly to prevent a burglar from pounding on said dial, while permitting said person to operate said knob to open said door without removing said security mask, and (g) an anti auto-dialer element mounted fixedly on said security mask in such relationship to said knob that driving engagement between said knob and an anti auto-dialer is prevented, and also in such relationship that manual operation of said knob is permitted.

2. The invention as claimed in claim 1, in which said anti autodialer element bridges over said knob between two spaced-apart parts of said security mask.

3. A safe for valuables, which comprises:

(a) a strong body having a space therein adapted to contain valuables, said body having an opening therein extending from said space to the exterior of said body, and through which objects may be passed into and out of said space, (b) a strong steel door provided on said body over said opening to block said opening when said door is in closed condition, (c) lock means to lock said door in closed condition, said lock means including a combination lock mechanism on the inside of said door, a knob on the outside of said door, and a spindle extending rotatably through said door between said knob and said lock mechanism so that rotations of said knob are transmitted by said spindle to said lock mechanism, said knob being coaxial with said spindle, said knob having a dial associated coaxially therewith on the outside of said door for rotation therewith, (d) means to provide indicia in fixed relationship to said door and adjacent said dial for cooperation with said dial in determining the correct rotated positions of said knob, (e) relocking means adapted to operate and prevent opening of said door in response to driving of said spindle axially thereof, (f) a strong steel security mask provided over said dial on the outside of said door.

said security mask being sufficiently strong to resist hammer blows by a burglar, to thereby cooperate with the securing means recited in the following clause (g) in preventing said burglar from removing said dial, said security mask having an opening therein sufficiently large to permit a person operating said knob to see said indicia and the portion of said dial near said indicia, said security mask and knob being so associated with each other that said knob may be manually operated at all times, and (g) means to strongly, fixedly and nonremovably secure said security mask to the outside of said door to thereby tend strongly to prevent said burglar from hammering on said dial, while permitting said person to operate said knob to open said door without removing said security mask.

4. The invention as claimed in claim 3, in which said knob is removably associated with said dial and spindle by a disconnectable drive means that is generally coaxial with said spindle, in which said mask extends over said spindle and has a hole therein registered with said spindle, and in which said knob has a stub shaft adapted to be inserted through said hole to said disconnectable drive means for driving connection to said spindle, whereby said knob may be removed by the operator and later reengaged when it is desired to open the safe.

5. The invention as claimed in claim 3, in which said security mask has an open bottom, and has sidewalls, said sidewalls having lower edges that seat on said door.

6. The invention as claimed in claim 5, in which said security mask is formed of a single piece of polygonal sheet steel that is bent downwardly to form sides, and that is welded at the corners.

7. The invention as claimed in claim 3, in which said security mask has a top wall that fits loosely adjacent said knob and permits said knob to be manually operated, and has sidewalls that extend down to said door, and in which said means to fixedly and strongly and nonremovably secure said mask to said door comprise means strongly associated with said sidewalls and with said door.

8. The invention as claimed in claim 7, in which said means to fixedly and strongly and nonrotatably secure said mask to said door comprise internally-threaded elements welded strongly to said sidewalls of said mask, said elements extending below the lower edges of said sidewalls, in which said door has counterbores therein on the upper side thereof wherein lower ends of said threaded elements are snugly received when the lower edges of said sidewalls are seated on said door, in which said door has bores therein on the lower side thereof, said bores being registered with said respective counterbores and being of smaller diameter, and in which screws are extended upwardly through said bores and are threaded into said internally-threaded elements to hold the same in said counterbores and thus hold said security mask firmly against the upper side of said door.

9. The invention as claimed in claim 8, in which small housings are welded to the lower side of said door, said housings having open upper ends seated on said door around said respective bores, said housings having closed lower ends that have internally-threaded bores therein that are coaxial with said bores and counterbores in said door, and in which set screws are threaded upwardly through said internally-threaded bores into tight bearing engagement with the heads of said screws.

* * * * *